US006182379B1

(12) United States Patent
Savage

(10) Patent No.: US 6,182,379 B1
(45) Date of Patent: Feb. 6, 2001

(54) ADJUSTABLE DEPTH TRACTION DEVICE FOR AN ATHLETIC SHOE

(76) Inventor: Steven R. Savage, 4945 Pine Meadow Pkwy. #1, Loves Park, IL (US) 61111

( * ) Notice: Under 35 U.S.C. 154(b), the term of this patent shall be extended for 0 days.

(21) Appl. No.: 09/543,435

(22) Filed: Apr. 5, 2000

Related U.S. Application Data

(63) Continuation of application No. 09/136,465, filed on Aug. 19, 1998.

(51) Int. Cl.[7] ..... A43B 5/00; A43B 23/28; A43C 15/00

(52) U.S. Cl. ..... 36/62; 36/65; 36/67 D; 36/59 R; 36/127; 36/134

(58) Field of Search ..... 36/61, 62, 65, 36/66, 59 A, 59 B, 67 R, 67 A, 67 B, 67 C, 67 D, 127, 134, 126, 128, 59 R, 64

(56) References Cited

U.S. PATENT DOCUMENTS

| | | | | |
|---|---|---|---|---|
| 1,827,514 | | 1/1931 | Golden | 36/62 |
| 2,292,238 | * | 8/1942 | Pierce et al. | 36/67 D |
| 2,506,801 | | 5/1950 | MacNeil | 36/62 |
| 3,328,901 | | 7/1967 | Strickland | 36/61 |
| 3,623,244 | | 11/1971 | Williams | 36/67 R |
| 4,299,038 | * | 11/1981 | Epple | 36/67 D |
| 4,783,913 | | 11/1988 | Aoyama | 36/67 D |
| 5,029,405 | * | 7/1991 | DeHaitre | 36/134 |
| 5,284,386 | | 2/1994 | Rubel | 36/127 |
| 5,293,701 | | 3/1994 | Sullivan | 36/59 R |
| 5,709,042 | * | 1/1998 | Houdroge | 36/67 D |
| 5,836,090 | * | 11/1998 | Smith | 36/134 |
| 5,906,059 | * | 5/1999 | Singer et al. | 36/134 |

FOREIGN PATENT DOCUMENTS

| | | | | |
|---|---|---|---|---|
| 1589 | * | of 1910 | (GB) | 36/67 A |
| 1263960 | | 2/1972 | (GB) | 36/67 A |
| 91/03179 | | 3/1991 | (WO) | 36/67 D |

* cited by examiner

*Primary Examiner*—Paul T. Sewell
*Assistant Examiner*—Anthony Stashick
(74) *Attorney, Agent, or Firm*—Leydig, Voit & Mayer, Ltd.

(57) ABSTRACT

An adjustable depth traction device for an athletic shoe which allows the shoe to be easily adapted to various terrains and course requirements. The present invention provides a traction device for an athletic shoe, typically a golf shoe, comprised of a base portion having a first length protrusion, and a second insert portion adapted to be attached to the first portion wherein the second insert portion has a length substantially greater than the first portion. Therefore, if the terrain warrants use of a long traction device and the course being played allows for use of such a device, the insert can be attached to the base portion. However, if the course does not allow use of such a long traction device, the insert can be easily and quickly removed from the base.

22 Claims, 9 Drawing Sheets

ADJUSTABLE DEPTH TRACTION DEVICE FOR AN ATHLETIC SHOE

This application is a continuation of U.S. application Ser. No. 09/136,465, filed Aug. 19, 1998.

FIELD OF THE INVENTION

The present invention generally relates to athletic shoes, and more particularly relates to traction devices for athletic shoes.

BACKGROUND OF THE INVENTION

Athletic shoes currently employ a number of different soles to provide various degrees of traction depending upon the surface being used. With outdoor activities, for example golf, a plurality of spikes have traditionally been provided on the base or sole of the shoe to allow for the shoe to puncture the surface of the ground and thereby provide traction in the relatively soft turf. The spikes have typically been manufactured from metal which serve well to provide the traction, but do become worn especially when used to traverse harder surfaces such as pavement and sidewalks which thereby requires the user to change the spikes periodically. As a result, the spikes are often threadably attached to the sole of the shoe.

One recent development in the golfing community has been the banning of such elongated metal spikes on many courses. It has been found that the metal spikes damage the turf of the course to a degree which is unsatisfactory to the proprietors of such golf courses. As a result, many courses now require that a smaller depth spike, typically manufactured from plastic or rubber, be used on the sole of the shoe. Rather than provide a single elongated metal spike, the newer plastic or rubberized traction devices typically include a number of different protrusions each of which is shorter in length than the typical elongated metal spike. While the shorter depth of such a plastic or rubberized traction device does alleviate many of the turf damage problems associated with elongated metal spikes, many players still wish to use the elongated metal spike. This is especially true with courses which are especially wet or which have terrain wherein the elongated metal spikes would be most advantageous.

In addition, while many courses have banned the use of such elongated metal spikes, many courses still allow their usage and since it is a preference of many players to still use the elongated metal spikes, both traction devices continue to be used today. The fact that two different types of traction devices are currently allowable on many courses has placed additional burdens on the players. For example, many players maintain two separate pairs of shoes, depending on the course being played. Alternatively, the process of changing one type of traction device for another results in a relatively time-consuming and frustrating process. It would therefore be advantageous if an athletic shoe were to be provided which would allow various types and depths of traction devices to be used and to be interchanged efficiently and quickly.

SUMMARY OF THE INVENTION

It is therefore a primary aim of the present invention to provide an adjustable depth traction device for an athletic shoe which allows the traction device to alter its depth of penetration easily and efficiently.

It is an object of the present invention to provide an adjustable depth traction device for an athletic shoe which can provide an elongated spike for use in soft terrains, and a shorter depth traction device for harder terrains and courses wherein elongated spikes are not allowed.

It is another object of one embodiment of the present invention to provide an adjustable depth traction device for an athletic shoe and means for preventing entry of debris into the traction device when the shorter depth spike is being employed.

It is a still further object to provide an adjustable depth traction device with interchangeable components.

In accordance with these aims and objectives, it is a feature of one embodiment of the present invention to provide a traction device for an athletic shoe comprised of a base adapted to be attached to the sole of an athletic shoe. The base has a plurality of protrusions therefrom which can serve to provide traction for the shoe when an elongated spike portion is not being used. However, the elongated spike portion is provided so that it can be attached to the base portion when additional traction is required and allowed.

It is another feature of one embodiment of the present invention to provide a two-piece traction device wherein the base portion and spike or insert can be manufactured from metal or plastic.

It is a still further feature of one embodiment of the present invention to provide a biasing means within the base portion with a cap attached to the biasing means such that when the metal insert is attached to the base, the biasing means is compressed, and when the metal insert is removed, the biasing means forces the cap outward and thereby substantially prevents intrusion of any debris into the base portion.

In a preferred embodiment of the present invention it is a feature to provide an adjustable traction device for an athletic shoe comprising a base portion and an insert removably attached to the base. The base portion includes protrusions therefrom and is attached to the sole of an athletic shoe. The insert has a length substantially greater than the length of the base protrusions.

In another embodiment of the present invention it is a feature to provide an athletic shoe comprising a sole, a plurality of spike bases attached to the sole, and a plurality of spike inserts removably attached to the plurality of spike bases. The spike bases each have extensions of a first length, while the spike inserts have a second length greater than the first length.

These and other aims, objectives and features of the invention will become more apparent from the following detailed description when taken in conjunction with the accompanying drawings.

Figure 1:
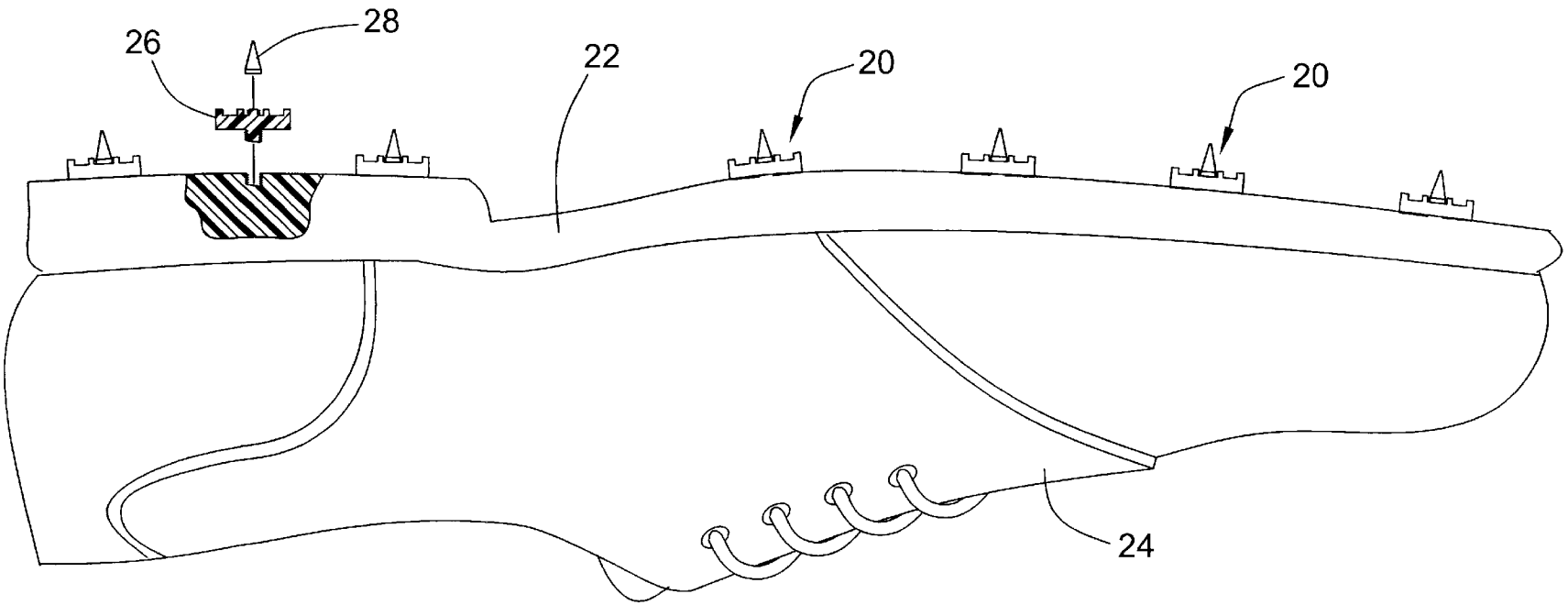
FIG. 1 is a side view of the preferred embodiment of the present invention fully assembled.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Referring now to the drawings, and with particular reference to FIG. 1 the preferred embodiment of the present invention is depicted as traction device 20. As shown therein, a plurality of traction devices 20 will typically be attached to sole 22 of athletic shoe 24. It is to be understood that the actual number of traction devices 20 is not of importance to the present invention but rather the actual design of traction device 20 is the focus of this invention. Moreover, while athletic shoe 24 is depicted as a golf shoe, it is to be understood that the present invention can be employed on any type of shoe wherein variable degrees of traction are required for proper usage. For example, athletic shoe 24 can be a shoe for use in playing football, soccer, baseball, lacrosse, mountain climbing, or any other outdoor activity.

Figure 2A:
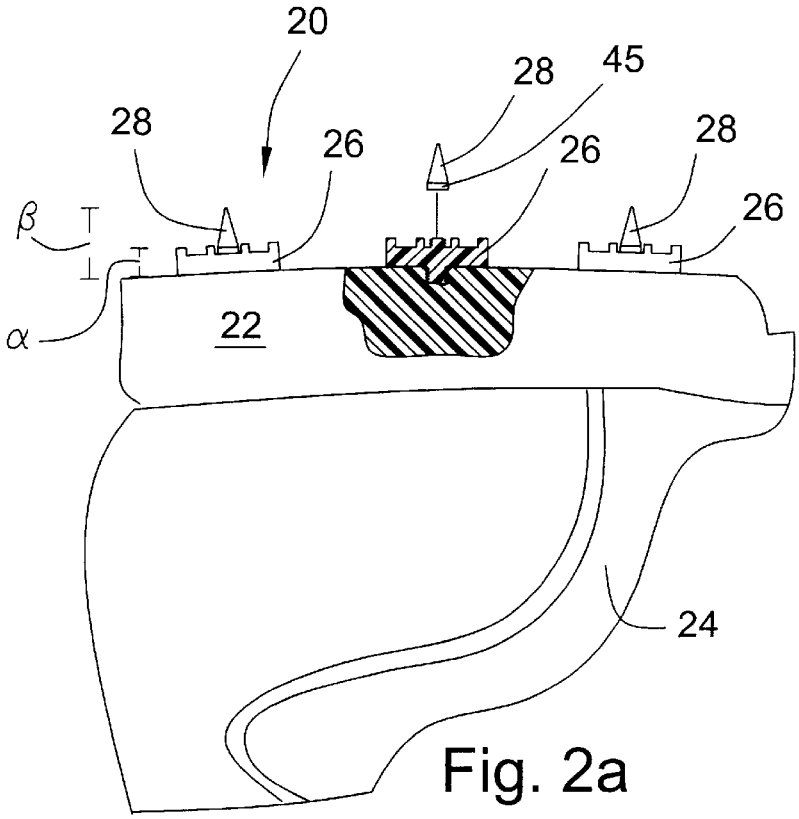
FIG. 2A is an enlarged view of a portion of the embodiment shown in FIG. 1.
Figure 2B:
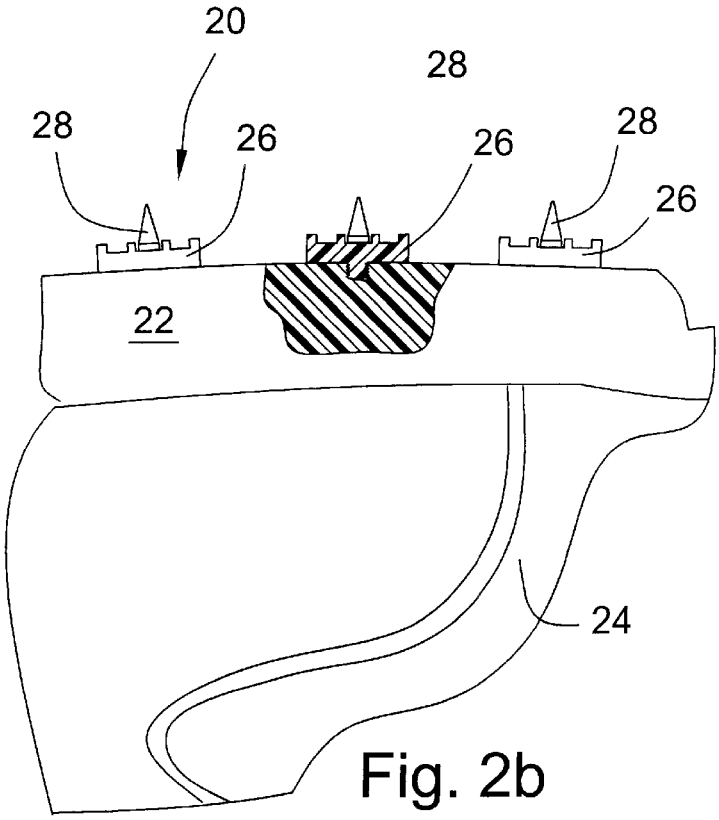
FIG. 2B is an enlarged view of the portion shown in FIG. 2A, but with the traction device assembled.
Figure 3:
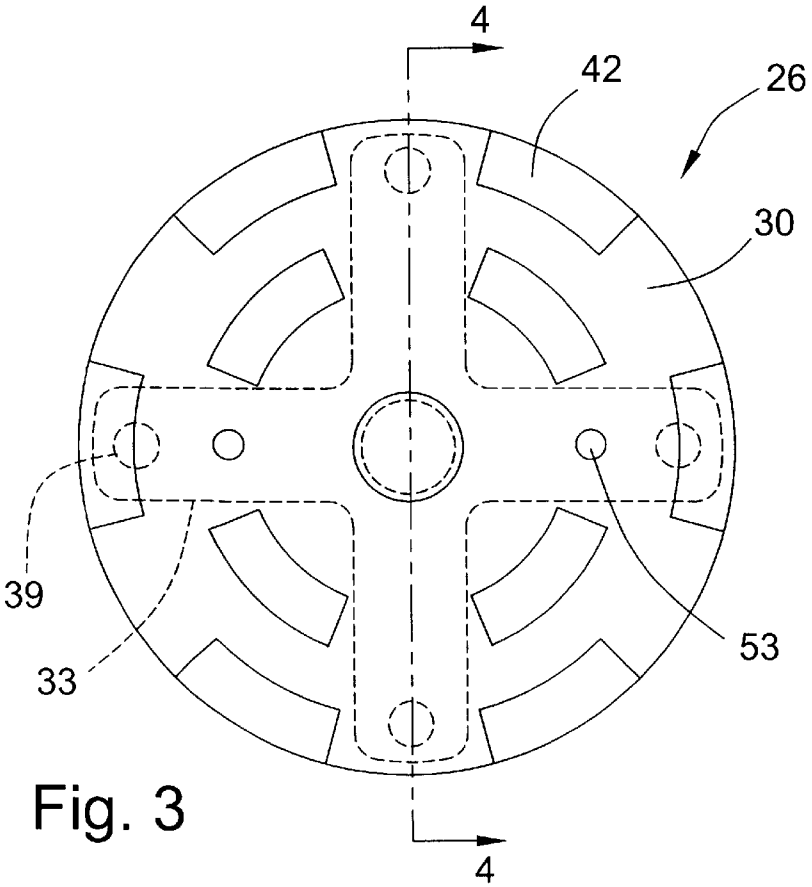
FIG. 3 is a top view of the preferred embodiment of the traction device assembled.

Turning now to the preferred embodiment of the present invention, it is shown in greater detail in FIGS. 2–3 as being comprised of base 26 and insert 28. As will readily be understood by one of ordinary skill in the art, if base 26 is used by itself, it will have a first length or depth of penetration $\alpha$, while if an insert 28 is attached to base 26, the combined length or depth of penetration will be much greater as represented by $\beta$. By providing a means by which insert 28 can be easily attached and detached from base 26, as will be described in further detail herein, the user of traction device 20 can tailor the athletic shoe to the given situation.

Figure 4:
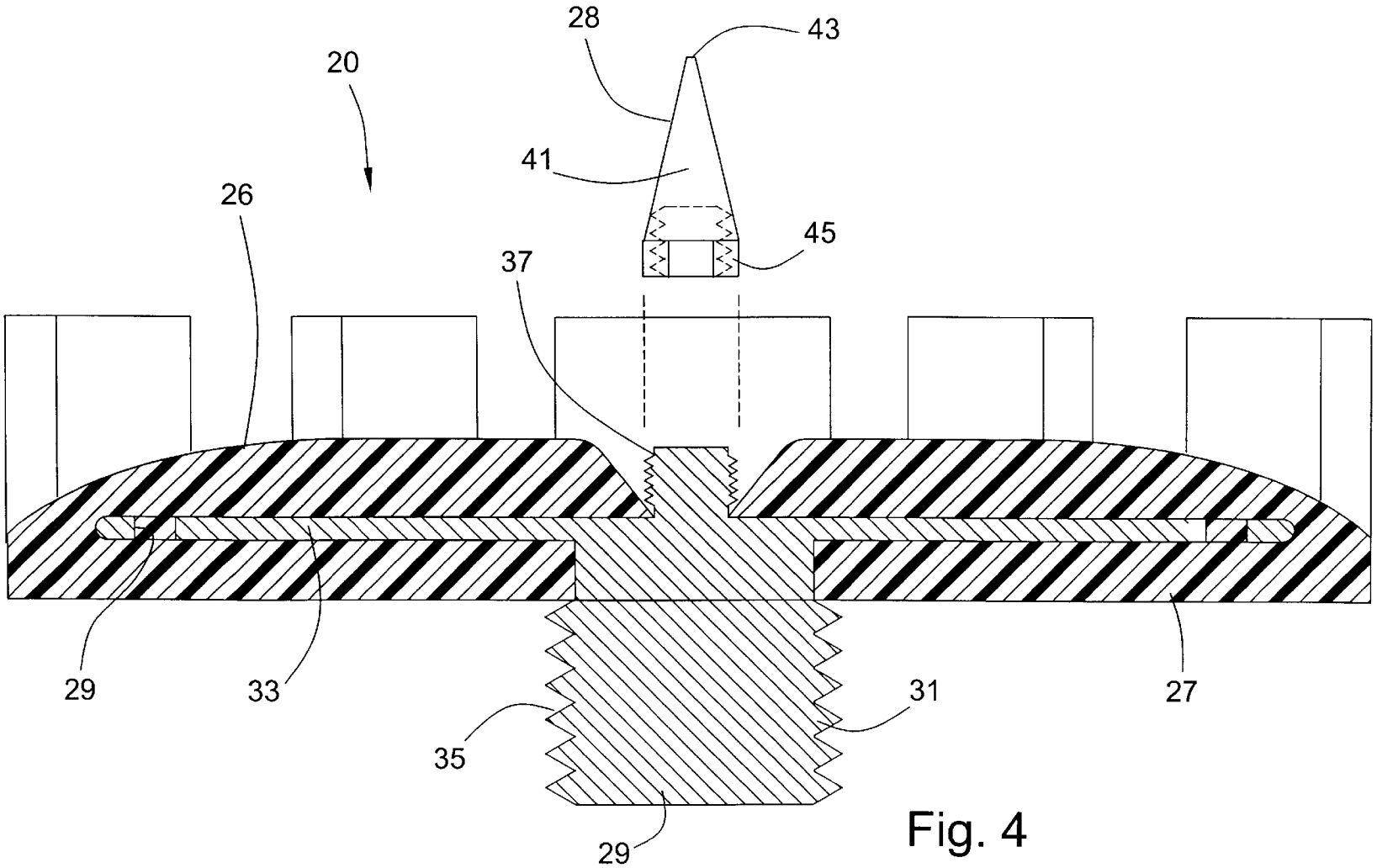
FIG. 4 is a sectional view taken along line 4—4 of FIG. 3.
Figure 5:
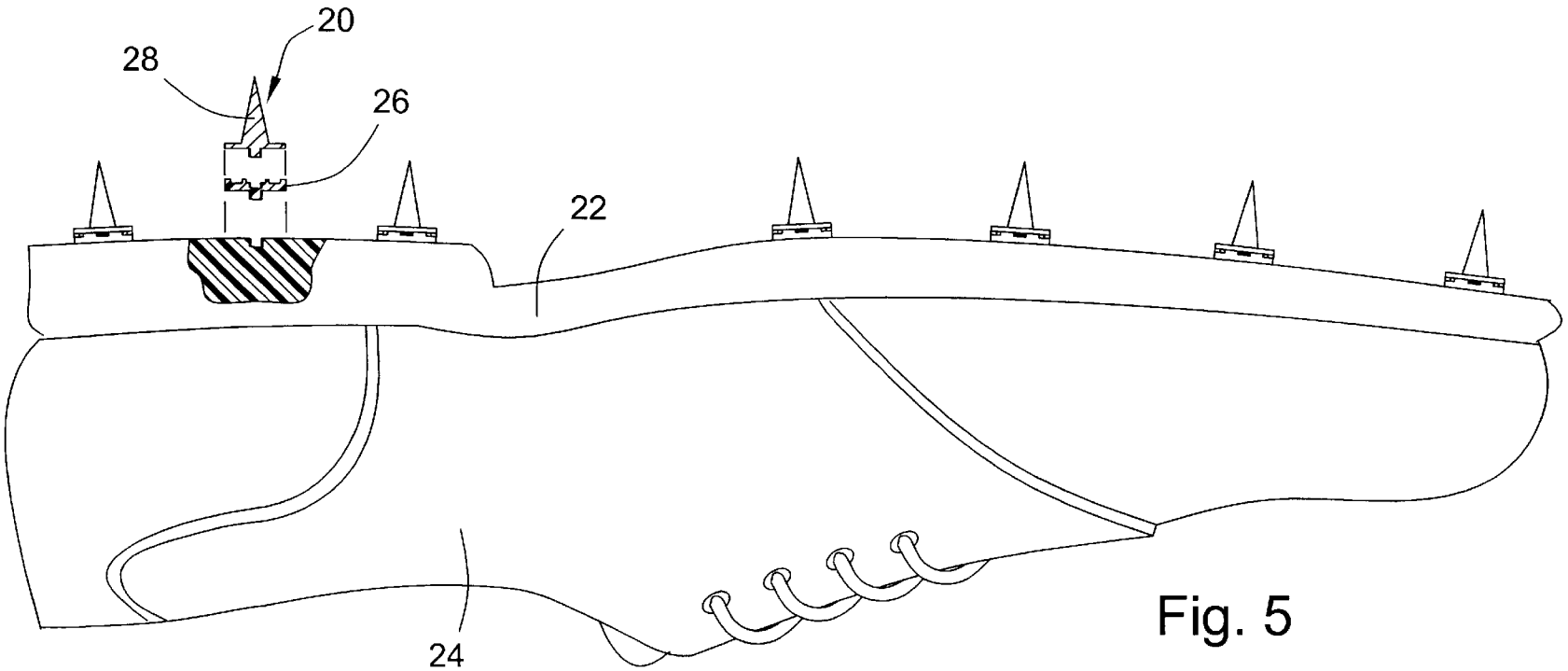
FIG. 5 is a side view of an alternative embodiment.
Figure 6A:
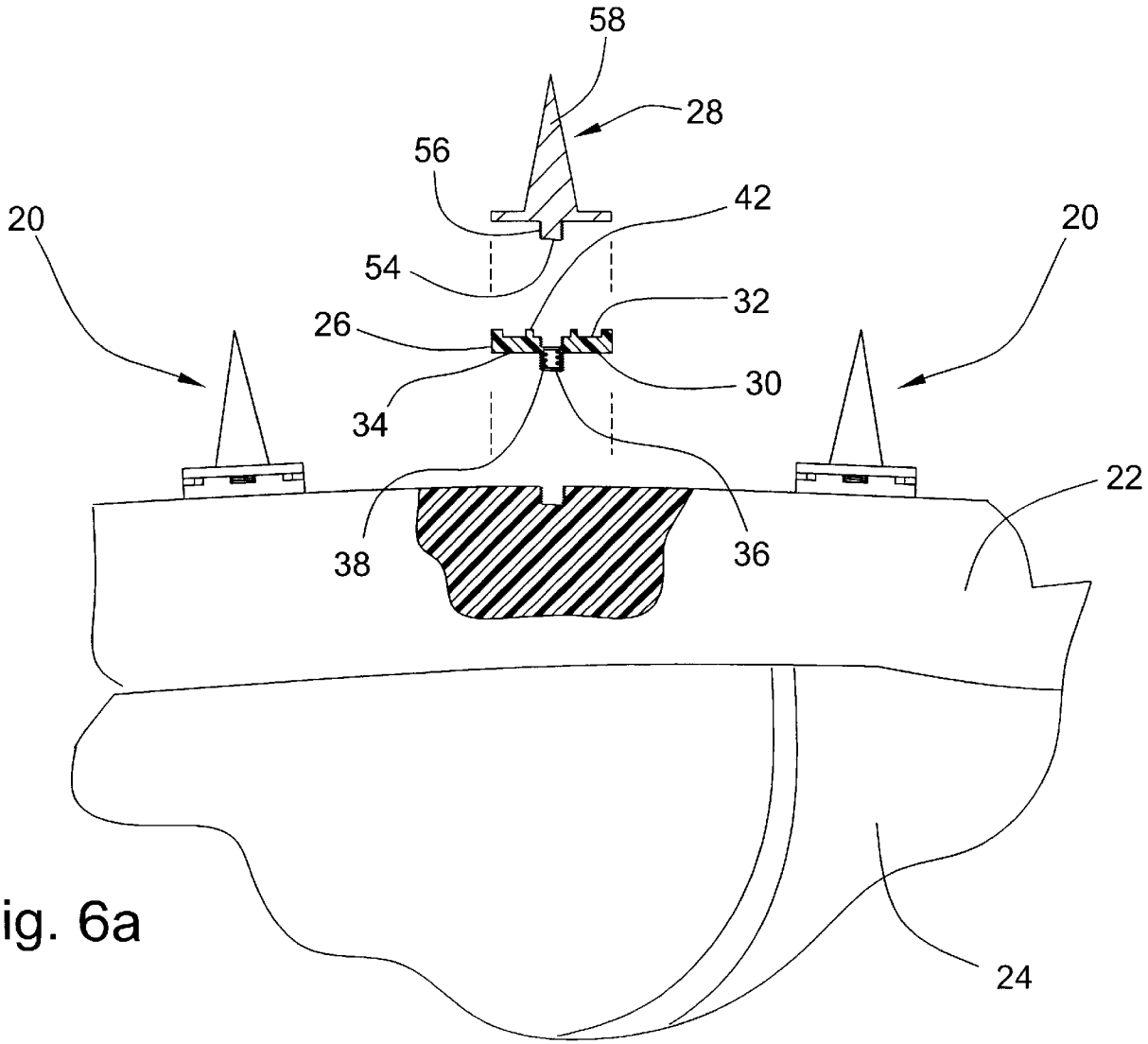
FIG. 6A is an enlarged view of a portion of the alternative embodiment shown in FIG. 5.
Figure 6B:
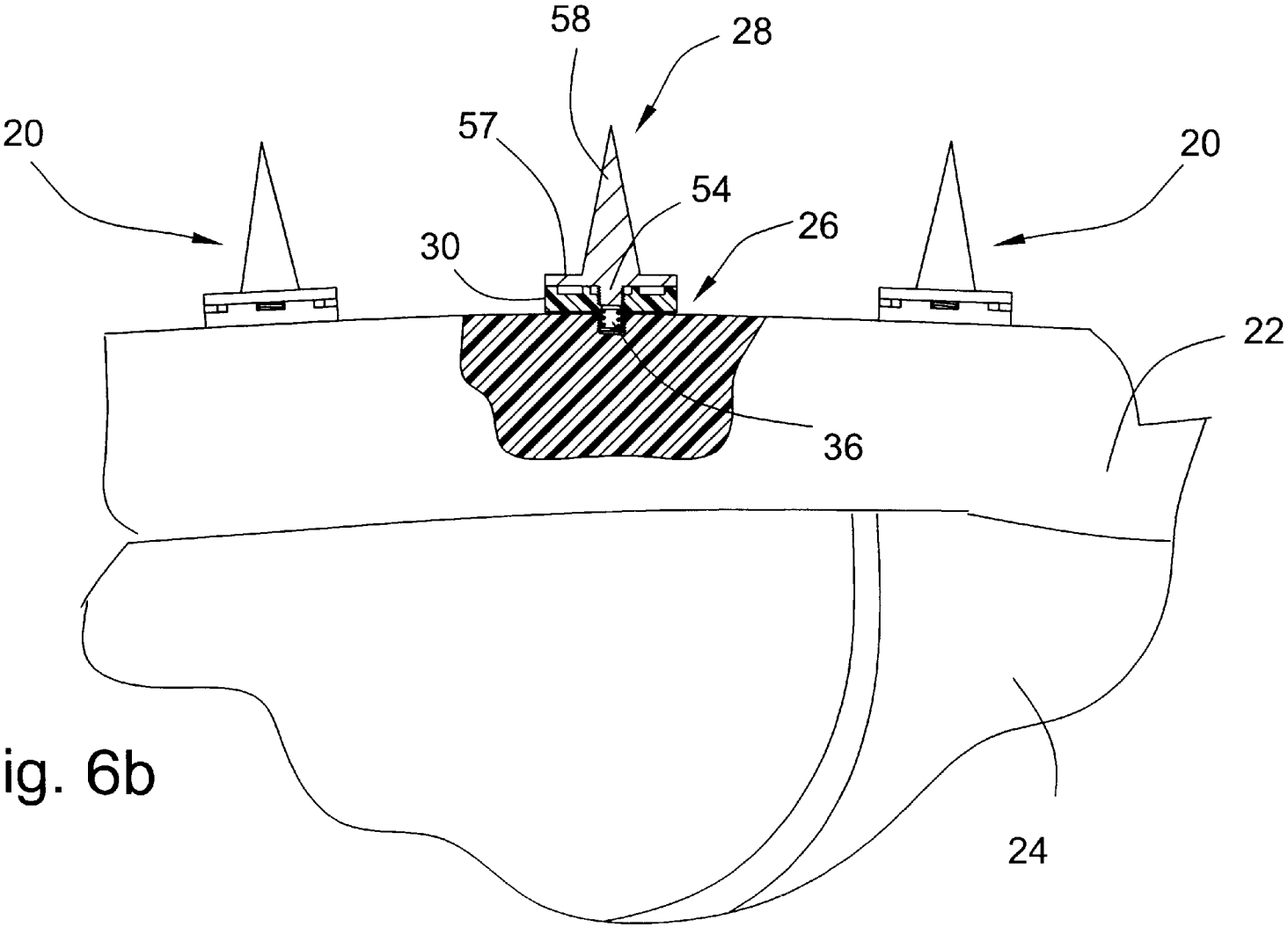
FIG. 6B is an enlarged view of the portion shown in FIG. 6A.

Base 26 is actually comprised of two main pieces in the preferred embodiment: molded plastic shell 27 and threaded foundation 29. As can be seen in either FIGS. 3 or 4, foundation 29 includes a threaded cylinder 31 as well as a plurality of radially extending arms 33. Cylinder 31 includes first set of external threads 35 which are adapted to be attached to an internally tapped hole provided in sole 22 of shoe 24, and a second set of external threads 37 adapted to attach to insert 28. Radial arms 33 are provided to ensure proper bonding between shell 27 and foundation 29 during the molding or forming process. In fact, each radial arm 33 includes an aperture 39 to allow for the plastic to penetrate through radial arms 33 and provide an even greater bond and better structural rigidity for traction device 20. It should be understood that while in the preferred embodiment, four individual radial arms 33 are depicted, in alternative embodiments a different number of radial arms 33 could be employed, or in fact, individual radial arms 33 need not be provided if less structural rigidity is acceptable. In addition, apertures 39 can be eliminated and thereby reduce the cost of the product if additional arms 33 are used to therefore increase the contact area between the shell 27 and foundation 29. Base 26 also includes a plurality of arcuate protrusions 42 which extend the depth of penetration of base 26 to $\alpha$.

Figure 9:
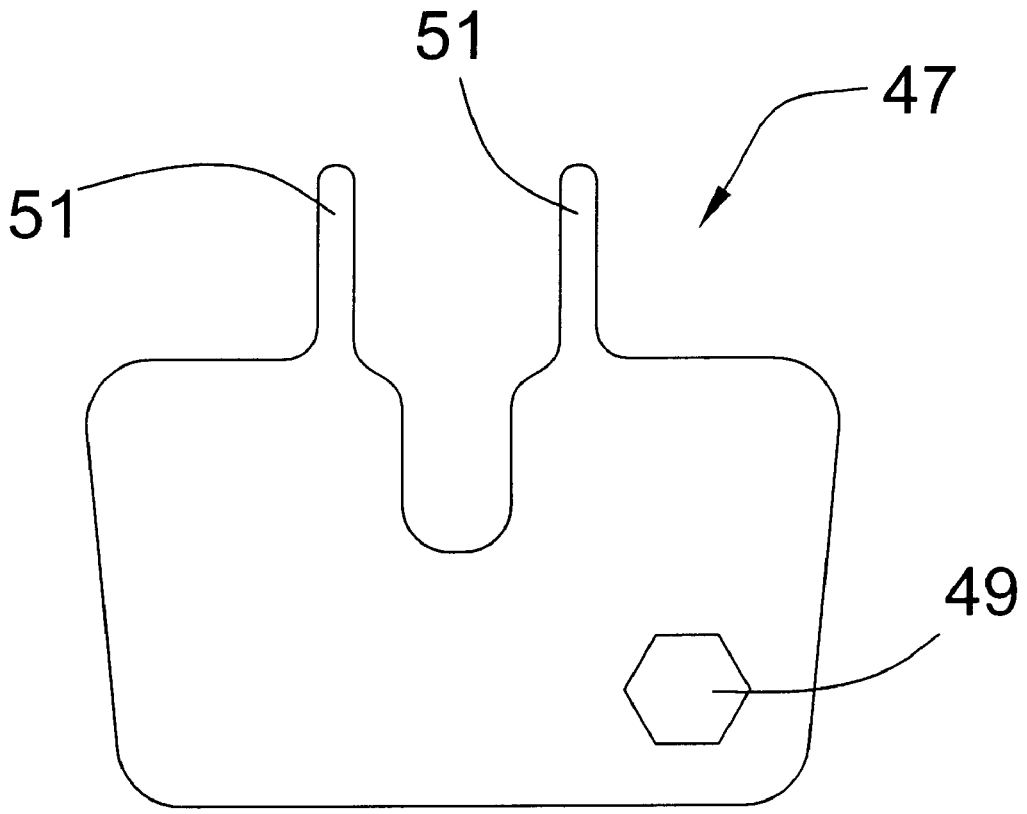
FIG. 9 is a side view of the tightening tool.

With respect to insert 28, in the preferred embodiment, it is depicted as including conical section 41 as well as apex 43 and hexagonal base 45. Base 45 is internally tapped to provide a mechanism by which insert 28 can be attached to second set of threads 37 provided on base 26. As can be seen from FIG. 2*a*, base 45 also includes a hexagonally shaped periphery to allow a conventional wrench to be used to tighten insert 28 onto base 26. Alternatively, tightening tool 47 as shown in FIG. 9 can be used. More specifically, it can be seen that tightening tool 47, which is a conventional tool provided with most golf shoes and spikes, includes a hexagonally shaped opening 49 for tightening insert 28 about hexagonal base 45 onto base 26. In addition, tool 47 includes tongs 51 as is conventional for tightening base 26 onto sole 22 using apertures 53. Base 45 need not be hexagonal as other shapes including octagonal bases, can be used as a tightening mechanism. Base 45 can also include a flange about its lower periphery for ease of manufacturability and thus to reduce cost.

An alternative embodiment is show in FIGS. 5–8. With respect to the actual structure of alternative traction device 20, it can be seen that the alternative embodiment of the present invention includes a base 26 and an insert 28 but of different structure. Base 26 includes circular portion 30 having top 32 as well as bottom 34. Stem 36 extends from bottom 34 and includes a plurality of external threads 38 adapted to threadably attach to internally tapped hole of sole 22. Top 32 of circular portion 30 includes, in the alternative embodiment, a plurality of extensions or protrusions 42 having a first length. As can be seen from FIG. 7, in the preferred embodiment of the present invention five protrusions 42 are provided wherein four are of a semicircular design 43 provided about the periphery of circular portion 30, and wherein a square crosssectional protrusion 48 is provided in the center of circular portion 30.

In order to provide for the attachment of insert 28 to base 26 and thus accomplish the interchangeability object of the present invention, square portion 48 is provided with aperture 50 which includes a plurality of internal threads 52. As can be seen from the sectional view of FIG. 8, aperture 50 extends into stem 36 and is concentric therewith. Leg 54 of insert 28 can thereby be inserted into aperture 50 and be rotationally or threadably attached thereto. This is accomplished by the provision of external threads 56 about the periphery of leg 54. In order to provide the extension or added length necessary for greater traction on certain courses, insert 28 includes rim 57 and conical extension 58 having a second length. As can be seen from any of the figures, the length of insert 28 is substantially greater than length of base 26 such that when insert 28 is attached to base 26, the overall length or extension of traction device 20 is greatly enhanced. Conversely, when insert 28 is removed from base 26, the overall length or depth of penetration of correction device 20 is substantially reduced.

With regard to the actual materials with which base 26 and insert 20 are manufactured, it should be understood that a variety of materials can be employed with similar efficacy. However, in the preferred embodiment, base 26 is manufactured from plastic or rubber, whereas insert 28 is manufactured from metal, preferably steel. Also in the preferred embodiment, internal threads 52 of aperture 50 are manufactured from metal whereas the remainder of base 26 is manufactured from the aforementioned plastic or rubber.

Figure 7:
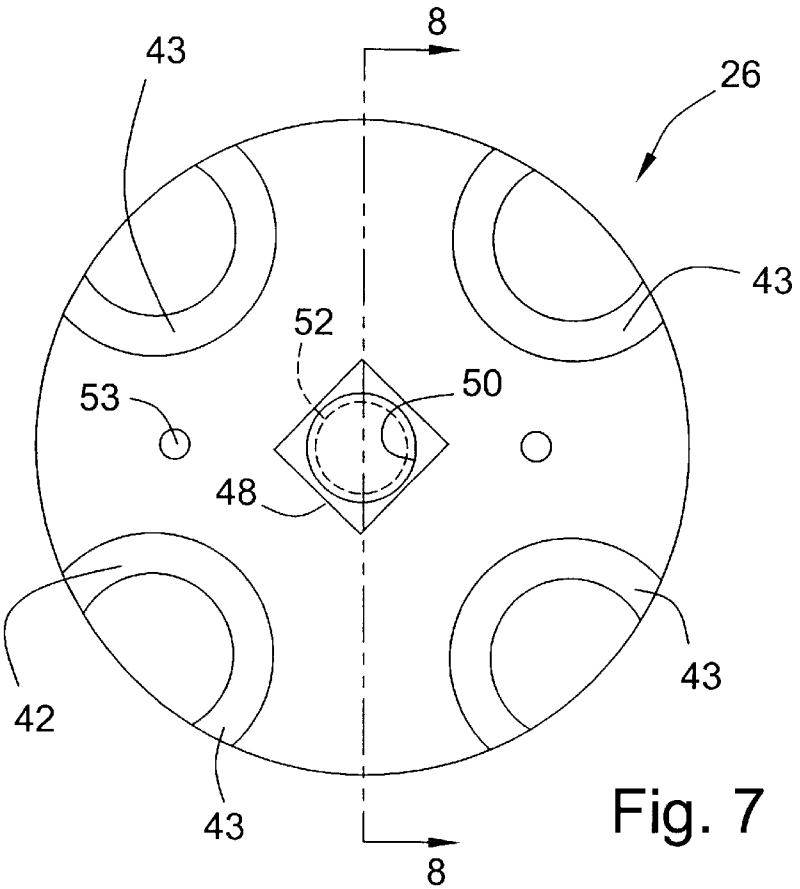
FIG. 7 is a top view of the alternative embodiment.
Figure 8:
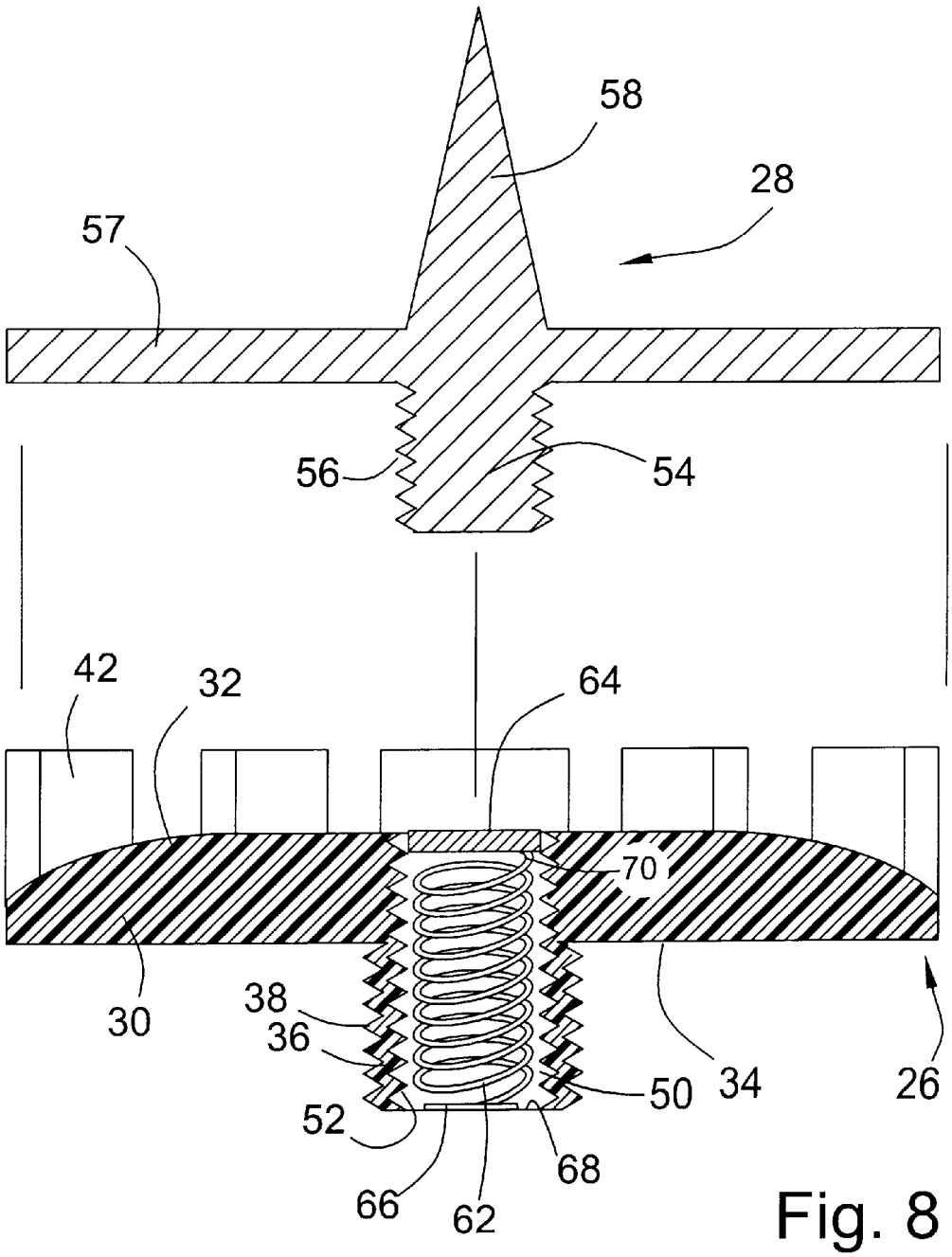
FIG. 8 is a sectional view of the alternative embodiment taken along line 8—8.

In certain situations, it may be advantageous to provide a means for preventing intrusion of debris or other contaminants into aperture 50 to thereby protect the life and usefulness of internal threads 52. In the alternative embodiment shown in FIGS. 5–8 of the present invention, this means for preventing is provided in the form of a spring 62 and a cap 64. As can clearly be seen in FIGS. 7 and 8, spring 62 is attached at first end 66 to base 68 of aperture 50, whereas second end 70 is attached to cap 64. Spring 62 is provided with sufficient resiliency and rigidity to allow for it to be compressed, as shown in FIG. 8, when insert 28 is threadably attached to base 26. However, when insert 28 is removed, the biasing force of spring 62 is sufficient to force cap 64 to the top of aperture 50 as shown in FIG. 7. Since cap 64 is dimensioned to be approximately equal to, and congruent in shape with, aperture 50, debris and other contaminants are substantially prohibited from entering aperture 50. Aperture 50 and internal threads 52 are thereby protected.

It is important to understand that while the depicted embodiment of the present invention does include spring 62 and cap 64, in alternative embodiments, other means for preventing entry of debris can be employed. Any biasing means other than a conventional coil spring 62 as depicted in FIGS. 5–8 can be used as well. It is important to understand that while the depicted embodiments all use male or female threads to attach the spike to the base, alternative attachment mechanisms including non-threaded, rotatable and spring biased locking devices can be used with similar efficacy.

From the foregoing, it can therefore be appreciated that the present invention provides a new and improved traction device for an athletic shoe which greatly enhances the versatility of the shoe. Depending upon the course and terrain being played, and the equipment limitations of the course, traction devices having various lengths and depths of penetration may be required. As opposed to prior art devices which are time-consuming and expensive, the present invention provides a method and means by which the actual traction device can be quickly and inexpensively altered to meet the needs and requirements of the given course. Moreover, through the provision of a unique means of preventing entry of debris into the traction device, the overall length of operation and usefulness of the device can be greatly enhanced.

What is claimed is:

1. An adjustable depth traction device for an athletic shoe having a sole, comprising:

a base portion having top and bottom sides, the base having first protrusions projecting from the bottom side to a first length, the adjustable depth traction device having the first protrusions of the first length when the base portion is attached to the sole of the athletic shoe;

a fastener integrally attached to the top side such that the top side of the base portion can be attached to the sole of the athletic shoe without needing other components; and an insert removably attached to the bottom side of the base portion, the insert forming a second protusion having a second length from the bottom side, the adjustable depth traction device having first protrusions of the first lengths and a second protusion of a second length when the insert is attached to the base, the second length being greater than the first lengths.

2. The adjustable depth traction device of claim 1 wherein the base portion is threadably attached to the sole of the athletic shoe.

3. The adjustable depth traction device of claim 1 wherein the insert is attached to the base portion using a non-threaded locking mechanism.

4. The adjustable depth traction device of claim 1 wherein the base portion is plastic.

5. The adjustable depth traction device of claim 1 wherein the insert includes an internally tapped hole, and the base portion includes an externally threaded shaft adapted to receive the internally tapped hole of the insert.

6. The adjustable depth traction device of claim 1 wherein the insert includes an externally threaded shaft, and the base portion includes an internally tapped hole adapted to receive the externally threaded shaft of the insert.

7. The adjustable depth traction device of claim 1 wherein the insert is metallic.

8. The adjustable depth traction device of claim 1 wherein the insert is plastic.

9. The adjustable depth traction device of claim 6 further including means for preventing entry of debris into the internally tapped hole when the insert is not attached to the base portion.

10. The adjustable depth traction device of claim 9 wherein the means for preventing is a spring provided in the internally tapped hole, the spring being attached to a base of the hole and a cap dimensioned to be congruent with the hole, the spring and cap being compressed into the hole when the insert is attached, the spring biasing the cap outward when the insert is removed.

11. The adjustable depth traction device of claim 1 wherein the base portion includes an external shell and a foundation, the foundation including a plurality of radially extending arms, the shell being attached to the foundation around the radially extending arms.

12. An athletic shoe, comprising:

a sole;

a plurality of spike bases attached to the sole of the shoe, the spike bases each having first extensions of a first length and a fastener integrally attached thereto such that each spike base can be attached to the sole of the shoe without needing other components, the first extensions adapted to provide traction; and a plurality of spike inserts removably attached to the plurality of spike bases, the spike inserts each having a second extension of a second length greater than the first length, the athletic shoe having extensions of a first length and second extensions of a second length when the spike inserts are attached to the spike bases.

13. The athletic shoe of claim 12 wherein the spike bases are threadably attached to the sole.

14. The athletic shoe of claim 12 wherein the spike bases are permanently attached to the sole.

15. The athletic shoe of claim 12 wherein the spike inserts each include an internally tapped hole, and the spike bases each include an externally threaded stem adapted to receive the internally tapped hole.

16. The athletic shoe of claim 12 wherein the spike inserts each include a conical extension and an externally threaded stem, and the spike bases each include an internally tapped hole adapted to receive the externally threaded stems.

17. The athletic shoe of claim 16 wherein the spike bases are plastic, and the internally tapped holes and spike inserts are metallic.

18. The athletic shoe of claim 16 wherein the internally tapped hole is within, and concentric with, an externally threaded shaft of the spike base.

19. The athletic shoe of claim 16 further including means for preventing entry of debris into the internally tapped hole when the insert is not attached.

20. The athletic shoe of claim 19 wherein the means for preventing is a spring disposed within the hole and cap attached to the spring, the spring being attached to a base of the hole and the cap being dimensioned to be congruent with the hole, the spring and cap being compressed into the hole when the insert is attached, the spring biasing the cap outward when the insert is removed.

21. The adjustable traction device of claim 1 wherein the first protrusions form a ring on the base portion and the insert is removably attached to the base within the ring.

22. The athletic shoe of claim 12 wherein the first extensions form a ring on each of the spike bases and the spike inserts are removably attached to the spike bases within the ring.

* * * * *